United States Patent [19]

Nasiatka et al.

[11] 4,230,249

[45] Oct. 28, 1980

[54] HAND-HELD FASTENER DRIVING TOOL

[75] Inventors: John R. Nasiatka, Northbrook; Ronald Austin, Hazelcrest; Ernest F. Schaudek, Franklin Park, all of Ill.

[73] Assignee: Duo-Fast Corporation, Franklin Park, Ill.

[21] Appl. No.: 921,979

[22] Filed: Jul. 5, 1978

[51] Int. Cl.[3] ..... B25C 5/06

[52] U.S. Cl. ..... 227/123; 173/119; 227/134

[58] Field of Search ..... 227/120, 123, 131, 134, 227/146; 173/119, 120, 121

[56] References Cited

U.S. PATENT DOCUMENTS

| | | | |
|---|---|---|---|
| 1,782,740 | 11/1930 | Mould | 173/121 |
| 2,714,209 | 8/1955 | Lindstrom | 227/123 |
| 3,035,268 | 5/1962 | Goldring | 227/123 |
| 3,215,324 | 11/1965 | Dorney | 227/123 |
| 3,272,417 | 9/1966 | Howard et al. | 227/123 |
| 3,347,439 | 10/1967 | Doherty | 227/109 |
| 3,482,754 | 12/1969 | Doherty | 227/131 |
| 3,853,257 | 12/1974 | Perkins | 227/123 |
| 4,005,812 | 2/1977 | Doyle et al. | 227/131 |

FOREIGN PATENT DOCUMENTS

| | | | |
|---|---|---|---|
| 671968 | 2/1939 | Fed. Rep. of Germany | 227/120 |
| 1071048 | 12/1959 | Fed. Rep. of Germany | 227/120 |
| 718579 | 11/1954 | United Kingdom | 227/134 |

*Primary Examiner*—John McQuade

*Attorney, Agent, or Firm*—Mason, Kolehmainen, Rathburn & Wyss

[57] ABSTRACT

An electric fastener driving tool includes a body of a clam-shell construction formed of two body parts that define a head and handle portions. An open bottom magazine assembly is attached to the tool for supplying fasteners to be driven. The tool also includes a removable nose piece defining a portion of a drive track for a driving blade mounted in the tool. The nosepiece includes different workpiece engaging surfaces on opposite ends such that the tool may be used to drive fasteners into different types of workpieces. The tool further includes a double cone spring for returning the driver to its at rest position.

34 Claims, 6 Drawing Figures

10
12
14
16
18
20
22
24
26
28
30
32
34
36
38
40
42
44
46
48
50
52
54
56
58
60
62
64
65
66
68
70
72
76
78
84
86
88
90
92
94
96
98
100
102
104
108
110
114
116
126
128
130
132
134
136
138
140
142
144
146
148
149
150
151
152
154

HAND-HELD FASTENER DRIVING TOOL

BACKGROUND OF THE INVENTION

A. Field of the Invention

The present invention relates to improvements in electric fastener driving tools.

B. Description of the Prior Art

Electric tools for driving fasteners such as staples, tacks and the like are well known and widely used. Examples of tools of this character may be found in U.S. Pat. Nos. 3,141,171; 3,172,121; 3,179,866; 3,434,026; and 4,005,812 all assigned to the assignee of the present invention. These tools illustrated in the above-identified patents set forth the basic components of the tool and are incorporated herein by reference.

The prior art tools commonly include a housing that defines a handle portion and a head or nose portion within which a solenoid winding is mounted for accelerating a magnetic armature. Specifically, a control circuit is operated by a switch in the handle portion for energizing the winding. A magazine is carried by the base of the head portion and by the handle for introducing fasteners into a drive track to be driven by a drive blade supported by the armature.

Normally, the armature of the prior art tools is connected to a second armature and to a single cone spring to allow overtravel of the blade and engagement with a bumper. After continued operation of the prior art tool, however, it often occurs that the bumper disintegrates resulting in the armature engaging a portion of the housing destroying the tool.

An additional problem with the typical prior art tool is its inability to be used on different work surfaces. One solution to the problem has been a removable jaw or nosepiece that is secured to the tool and must be removed through the employment of tools in order to secure a different jaw to the workpiece.

Another frequent problem with prior art tools is jamming of fasteners in the magazine assembly requiring complete disassembly of the tool to clear the jam.

SUMMARY OF THE INVENTION

One of the important objects of the present invention is to provide a tool which is light in weight, is easily and economically manufactured, and includes relatively few parts requiring a minimum of assembly operations.

Another object of the present invention is to provide a new and improved electric fastener driving tool that includes a nose piece that is removable and reversible to orient a desired workpiece engagement surface on the nose piece to engage the workpiece.

A further object of the present invention is to provide a new and improved magazine for an electric fastener driving tool that is inexpensive to manufacture and accomodates a variety of types of workpieces into which fasteners are driven.

An additonal object of the present invention is to provide a new and improved electric fastener driving tool that includes a magazine assembly that is of a configuration allowing a jam to be easily corrected.

Another object of the present invention is to provide a new and improved return spring and plunger blade assembly that prevent destruction of an electric fastener driving tool upon disintegration of the bumper normally engaged by the plunger.

The present invention is directed to a new and improved electric tool for driving fasteners such as staples and the like. The tool includes a housing that defines the handle, a head, a nose and tail portions. A solenoid is resiliently and firmly mounted within the housing and includes a magnetic armature to which a driver is mounted. The armature includes a double cone spring mounted thereon that functions to allow overtravel of the driver during the driving stroke and to protect against damage of the housing of the tool if the bumper against which the armature engages during the downward stroke disintegrates. In addition, this spring may eliminate the need for such a bumper.

A drive track is defined by a magazine and by a nosepiece or jaw removably connected to the magazine. The jaw is held in position by a spring and includes first and second ends that may be of different configurations to accomodate different types of workpieces.

The tool also includes a magazine assembly with an open bottom exposing the fasteners thereby allowing easy clearing of the jams that may occur in the magazine assembly.

DESCRIPTION OF THE DRAWINGS

The above and other objects and advantages and novel features of the present invention will become apparent from the following detailed description of a preferred embodiment of the invention illustrated in the accompanying drawings wherein.

DETAILED DESCRIPTION OF A PREFERRED EMBODIMENT

Figure 1:
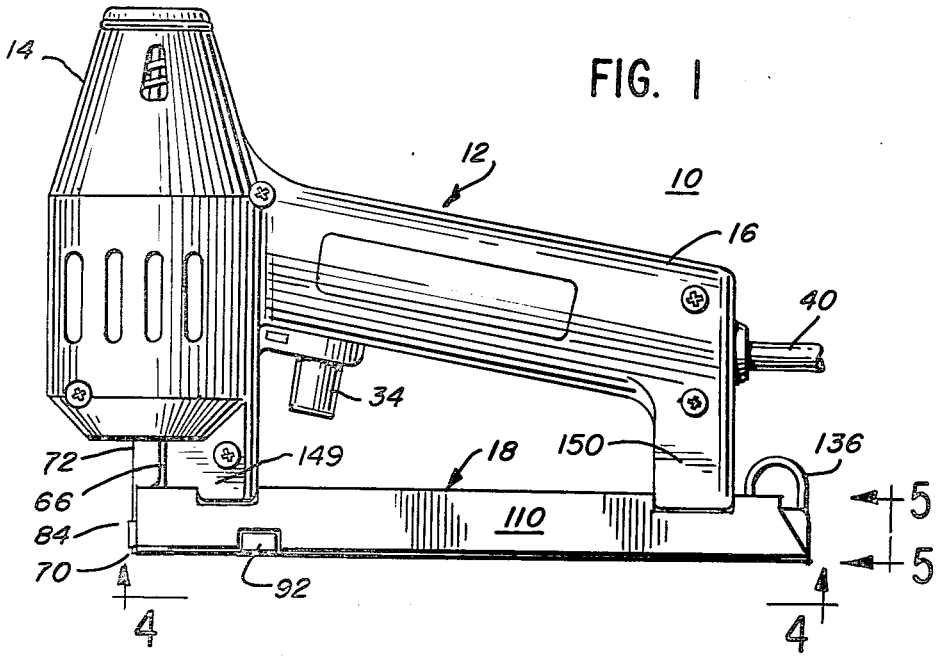
FIG. 1 is a side view of the tool constructed in accordance with the principles of the present invention.
Figure 3:
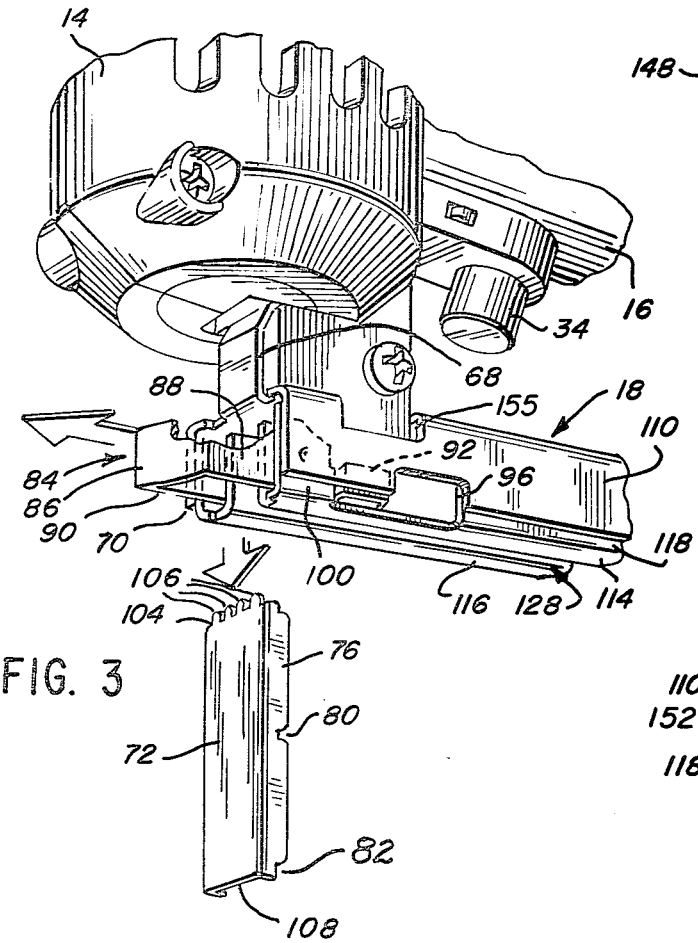
FIG. 3 is a partial view of the tool of the present invention with the workpiece engaging jaw partially removed.
Figure 6:
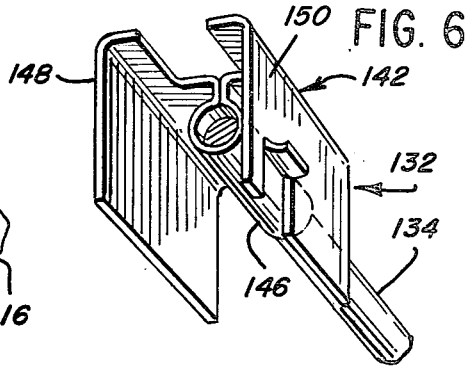
FIG. 6 is a view of the pusher used in the tool.
Figure 5:
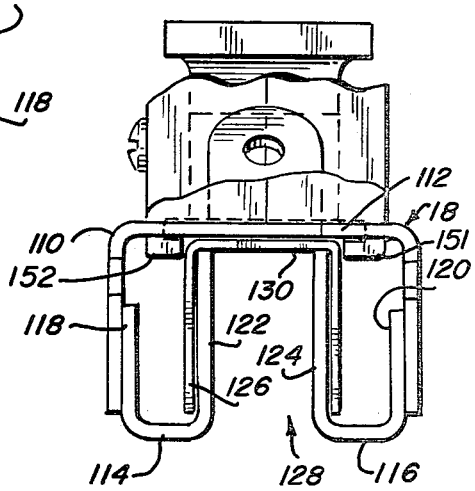
FIG. 5 is a view taken along line 5—5 of FIG. 1.
Figures 2, 4:
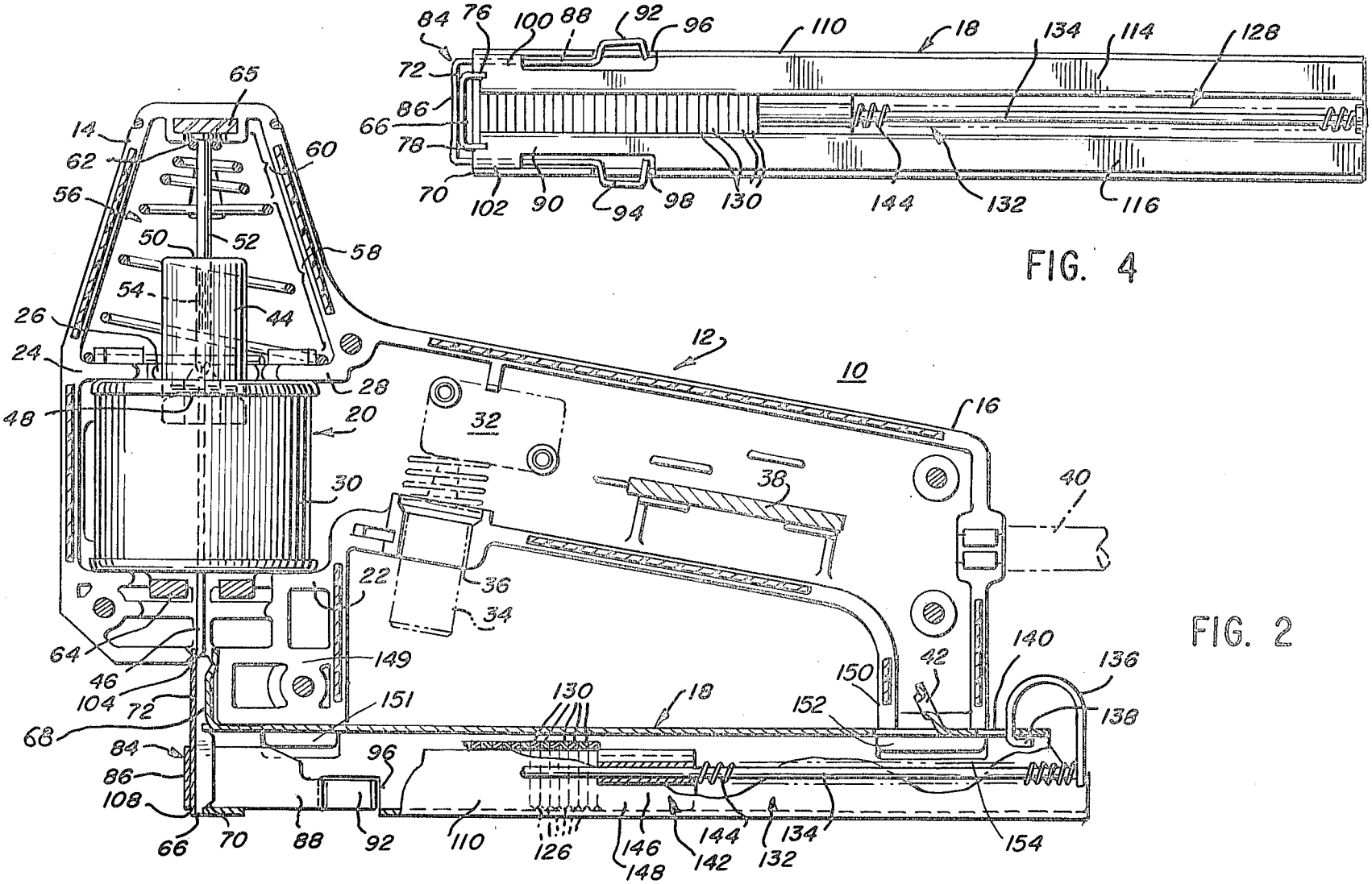
FIG. 2 is a vertical, cross-sectional view of the tool of the present invention.
FIG. 4 is a bottom, plan view taken along line 4—4 of FIG. 1.

With reference now to the figures and initially to FIG. 1, there is illustrated an electric fastener driving tool designated as a whole by the reference numeral 10 and constructed in accordance with the principles of the present invention. The tool 10 is similar in many respects to the tool disclosed in U.S. Pat. No. 4,005,812. For this reason, this patent is incorporated by reference herein and the well known components of the tool 10 will only be briefly discribed.

The tool 10 is designed for portable hand-held use and includes a housing and body generally designated by the reference numeral 12 that includes a head portion 14 a nose portion 149, a tail portion 150 and a handle portion 16; the latter being adapted to be grasped by the hand of the user of the tool 10. A magazine assembly generally designated by the reference numeral 18 is attached to the tool 10 and is adapted to contain a supply of fasteners that are to be driven by the tool. The nose portion 149 and tail portion 150 include molded projections 151 and 152 for securely attaching the magazine assembly 18 to the housing 12 by fitting through apertures 154, 155 and in the U-shaped frame 110. The head portion 14 of the tool is adapted to contain a solenoid 20 that is held at the bottom by a ring 22 formed on the inner peripheral surface of the head portion 14 and at the upper end by three molded fingers 24, 26 and 28.

In this manner, the fingers 24, 26 and 28 provide a resilient biasing force tending to bias the metal cup 30 and the solenoid 20 into engagement with the ring 22 with sufficient force to prevent shaking or movement of the solenoid 20 relative to the tool housing 12 during operation thus preventing damage to the solenoid 20.

The solenoid 20 is electrically connected to a switch 32 that may be actuated by a plunger 34 that is mounted within an aperture 36 in the handle portion 16 of the tool 10. The microswitch 32 is electrically connected to a circuit board 38 that in turr is electrically connected to a power cord 40 mounted in the handle portion 16 of the tool 10 that is adapted to be coupled to a source of electrical energy. The power cord 40 is also grounded with the grounding fastener 42 so as to ground the magazine 18.

The magnetic armature of the solenoid 20 is provided by the magnetic plunger 44 mounted for reciprocal movement within the solenoid 20. A driver blade 46 is secured to the plunger 44 by a roll pin 48. The plunger 44 includes an elongated bore 50 within which a plunger extension in the form of a common fastener or nail 52 is press fit through the employment of knurling 54 of the outer surface of the extension 52.

In accordance with an important feature of the present invention, it is desirable to allow overtravel of the plunger 44 during a driving stroke while preventing destruction of the tool 10. Accordingly, surrounding the plunger 44 and extension 52 is a double cone spring generally designated by the reference numeral 56. The lower or first cone portion 58 of the spring 56 is positioned on top of the fingers 24,26 and 28 formed in the housing 12 of the tool 10. The spring portion 58 defines a truncated cone spring similar to that used in prior art tools; however, the spring 56 differs from the prior art springs in that it includes an upper or second cone portion 60 integrally defined with the first cone spring 58. The upper end of the second cone portion 60 surrounds and is engaged by the head 62 of the nail 52. The bumper 64 is supported by cup 30 as shown in U.S. Pat. No. 4,005,812.

The double cone spring 56 provides two flexure rates allowing substantially unresisted travel of the plunger 44 during a drive stroke until the bumper 64 is engaged by the plunger 44. Thereafter, the spring 56 resists further travel of the plunger 44. To accomplish this dual resistance, the first cone portion 58 is fabricated to be more resilient allowing easy flexing. The second cone 60, however, is more tightly wound and, thus, stiffer allowing less flexing. Accordingly, during the downward movement of plunger 44 and just at or prior to engagement with the bumper 64, the first cone portion 58 is substantially fully compressed. After engagement with the bumper 64, the second cone portion 60 begins to compress and due to its greater stiffness, prevents further travel of the plunger 44. Thereafter, the spring 56 operates to return the plunger 44 and the driver blade 46 to their original at rest position whereupon head 62 of the nail 52 engages the disc bumper 65.

As described, the second cone portion 60 serves as a safety such that if the bumper 64 disintegrates during use, the second cone portion 60 prevents engagement of the plunger 44 with any portion of the housing 12 that could result in destruction of the housing 12. Moreover, the bumper 64 could be completely eliminated with the function of the bumper served by the second cone portion 60.

The tool 10 may be used on different workpieces and includes a feature that allows easy clearing of jammed fasteners. The driver blade 46 travels along a drive track 66 defined in part by the vertical member 68 and the leading edge 70 of the magazine 18. The front portion of the drive track 66 is defined by a nose piece or jaw 72 that is removably mounted in the magazine 19. More specifically, the leading edge 70 of the magazine 18 is adapted to engage and hold the jaw 72. To accomplish this holding or securement of the jaw 72 to the leading edge 70, the jaw 72 includes side flanges 76 and 78 each with slots 80 82. The leading edge 70 is inserted into the slots 80 and 82 aligning the jaw 72 in the magazine 18 and maintaining in position to define the forward portion of the drive track 66.

The side flanges 76 and 78 of the jaw 72 are biased against and engage the magazine 18 through the employment of a spring clip 84. The spring clip 84 is generally U-shaped including a bight portion 86 that engages the jaw 72. The clip 84 also includes legs 88 and 90 that are adapted to extend along the magazine 18. The legs 88 and 90 include detent portions 92 and 94, respectively, that resiliently snap into and are held by apertures 96 and 98 defined on the magazine assembly 18 thus serving to clip or releasably hold the spring clip 84 and the jaw 72 to the magazine assembly 18. If it is desired to remove the jaw 72, the detent portions 92 and 94 can be forced out of the apertures 96 and 98 by the use of the fingers of the user. The bight portion 86 of the spring clip 84 may then be grasped to move the clip 84 out of the magazine assembly 18 to a position whereupon the detent portions 92 and 94 engage flanges 100 and 102 of the magazine 18 preventing further withdrawal. Thereafter the jaw 72 may be grasped by the user and moved such that the leading edge 70 is moved out of engagement with the slots 80 and 82 and then be completely removed from the magazine 18. The removal of the jaw 72 is desirable to allow clearing of the drive track 66 of jammed fasteners. It is also desirable to be able to remove the jaw 72 to allow reversal of the ends of the jaw 72 to select the end that will engage the workpiece. More specifically, in the preferred embodiment illustrated the jaw 72 includes a first end 104 including teeth 106 defined thereon. The end 104 defines a workpiece engaging surface and that may be of any design or configuration depending on which of several workpieces the tool 10 may be used. In the preferred embodiment illustrated, the end 104 includes teeth 106 that may be used for gripping a screen or the like.

The jaw 72 also includes a second end 108 that as illustrated is flat and may serve as the working engaging surface for engaging a flat workpiece, such a board or the like. Other types of jaws 72 may be employed, for example, the end 108 may include a central recess that straddles a wire cable if it is desired to staple or fasten a wire cable to a workpiece.

As can be understood from the above description of the preferred embodiment, the jaw 72 provides the user of the tool 10 with the ability to easily clear a jam and to use the tool on different types of workpieces.

Considering now the magazine assembly 18. The assembly 18 is defined by three different portions that may be integral or of three different parts. More specifically, the magazine assembly 18 includes a U-shaped frame 110 a vertical member 68 that defines a portion of the drive track 66 and; with a bight portion 112 that defines the top or cover of the magazine assembly 18. The magazine assembly 18 also includes two similar track members 114 and 116 that may be integrally defined with the frame 112 or may be separate pieces attached to the frame 112 by techniques well known in the art such as spot welding. The tracks 114 and 116 are also U-shaped including legs of unequal lengths. The shorter legs 118 and 120 of the tracks 114 and 116, respectively, are secured to the inner peripheral sides of the frame 110 or may be integral portions thereof. The longer legs 122 and 124 are not attached to the frame 110 and define support portions that are straddled by fasteners such as staples 126.

The magazine assembly 118 constructed as described above defines an open space 128 between the legs 122 and 124 exposing the crown portions 130 of the fasteners 126. Accordingly, if a jam occurs within the magazine assembly 18, the fasteners 126 are accessible by a tool such as a screw driver without disassembling the tool 10 or the magazine assembly 18 allowing the jam to be cleared with minimum of difficulty. If the jam is not easily cleared, the jaw 72 may be removed from the magazine 18 and the fasteners 126 may be engaged by a tool and forced through the nose portion thus releasing the jam. In addition, the space 128 defined by the magazine assembly 118 may be of sufficient dimension to straddle a wire cable when the tool 10 is employed to fasten the cable to a workpiece.

Mounted within the magazine is a pusher assembly generally designated by the reference numeral 132. The pusher assembly includes a pusher rod 134 that is secured to a pusher lock 136 that includes a detent 138 for being engaged in an aperture 140 defined in the magazine frame 110.

A pusher 142 is slideably mounted on the rod 134 and is biased away from the lock 136 by a spring 144. The pusher 142 may be fabricated from a single piece of material such as a metal plate and is formed with a central bore 146 that surrounds and is supported by the rod 134. The bore 146 is of a sufficient axial length such that the pusher 142 is dimensionally stable on the rod 134 and does not wobble thereon. The pusher 142 also includes wings or ams 148 and 150 that straddle the legs 122 and 124 of the track 114 and 116 and engage the fasteners 126 tending to move them along the tracks 114 and 116 toward the drive track 66 of the tool.

Obviously, many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. In a fastener driving tool of the type including a housing defining a handle portion and a head portion, a drive track defined in said head portion, a driver blade mounted in said drive track and means for reciprocating said blade in said track, the improvement comprising a plunger secured to said blade mounted in said head portion and reciprocated therein by said reciprocating means, one piece biasing means for biasing said plunger to an at rest position, said biasing means including a first portion of a first predetermined flexibility and a second portion of a second predetermined flexibility a workpiece engaging jaw removably secured to said head portion and defining a portion of said drive track, said jaw includes first and second workpiece engaging portions of different configurations for engaging different workpieces.

2. The improvement to said tool set forth in claim 1 wherein said biasing means comprises a double cone spring including a first portion of a first preselected stiffness and a second portion of a second preselected stiffness.

3. The improvement to said tool set forth in claim 1 wherein said reciprocating means comprises a solenoid and said plunger comprises an armature of said solenoid.

4. The improvement to said tool set forth in claim 3 wherein said head portion includes spring members defined thereon engaging and securely holding said solenoid in the housing.

5. The improvement to said tool set forth in claim 1 further comprising a clip member for releasably holding said jaw onto said head portion.

6. The improvement to said tool set forth in claim 1 further comprising a magazine assembly secured to said housing, said magazine assembly including a frame member including an open bottom and at least one fastener support member mounted in said frame member for supporting said fasteners over said open bottom allowing access to said fasteners in said magazine assembly.

7. The improvement to said tool set forth in claim 1 further comprising a connecting stem secured to said plunger and to one of said first and second portions of said biasing means.

8. A fastener driving tool comprising:

a housing defining a nose portion and a handle portion, said nose portion defining a first portion of a drive track;

a driver blade mounted for reciprocation in said drive track; and a nose piece defining a second portion of said drive track, said nosepiece removably secured to said housing and including first and second workpiece engaging ends of different configuration.

9. The tool claimed in claim 8 further comprising a fastener magazine assembly secured to said housing, said magazine assembly including a frame defining an open bottom providing access to said fasteners.

10. The tool claimed in claim 8 further comprising means for driving said blade and biasing means for returning said blade to a normal, at rest position, said biasing means comprising a double cone spring including a first portion of a first flexibility and a second portion of a second flexibility.

11. A fastener driving tool comprising:

a body defining a handle portion and a nose portion;

a drive track defined at least in part by said nose portion;

a driver for driving fasteners mounted in said drive track;

a magazine assembly for supplying said fasteners to said drive track, said magazine assembly including a frame and at least one track member for supporting said fasteners in said frame, said frame defining an unobstructed open bottom allowing access to said fasteners in said magazine assembly, and a removable jaw attached to said nose portion and defining at least a portion of said drive track, said jaw including first and second workpiece engaging surfaces of different configurations.

12. The tool claimed in claim 11 wherein said frame is of an inverted U-shaped configuration and said track member is of a U-shaped configuration with a first leg longer than a second leg said second leg secured to said frame and said first leg supporting said fasteners.

13. The tool claimed in claim 11 further comprising return means for returning said driver to a ready to fire position, said return means including a solenoid mounted in said housing, a magnetic armature of said solenoid mounted in said housing, said driver connected to said armature, a connecting rod secured to said armature, and a spring including a first portion engaging said housing and a second portion secured to said rod, said second portion being less flexible than said first portion.

14. A fastener driving tool for driving fasteners into a workpiece comprising:

a body defining a nose portion and a gripping portion;

a drive track defined in part by said nose portion;

a removable nose piece defining another part of said drive track;

a driving blade for driving said fasteners mounted in said drive track;

means for driving said blade;

return means for returning said blade to an at rest position, said return means including a plunger connected to said blade, a rod connected to said plunger and a biasing element connected to said rod; and a U-shaped magazine for supplying fasteners to said drive track, said magazine including an unobstructed open bottom allowing access to said fasteners in said magazine at least adjacent to said drive track, said nosepiece includes first and second-selectable workpiece engaging surfaces.

15. The tool set forth in claim 14 wherein said biasing element comprises a spring including a first, rigid portion secured to said rod and a second less rigid portion relative to said first portion engaging said body.

16. The tool set forth in claim 14 wherein said magazine includes an inverted U-shaped frame defining the top of said magazine and at least one fastener support track in said frame.

17. A fastener driving tool comprising:

a housing defining nose and handle portions and a drive track, a magazine mounted on said housing for supplying fasteners to said drive track, a driver blade mounted in said housing for reciprocation in said drive track, and a nose piece removably secured to said housing and including first and second workpiece engaging ends of different configurations.

18. The tool claimed in claim 17 wherein said nose piece defines a portion of said drive track.

19. The tool claimed in claim 17 wherein said magazine includes a frame defining an open bottom providing access to fasteners contained in said magazine.

20. In a fastener driving tool of the type including a housing defining a handle portion and a head portion, a drive track defined in said head portion, a driver blade mounted in said drive track and means for reciprocating said blade in said track, the improvement comprising a plunger secured to said blade and mounted in said head portion and reciprocated therein by said reciprocating means, biasing means for biasing said plunger to an at rest position, said biasing means comprises a double cone spring including a first portion of a first preselected stiffness and a second portion of a second preselected stiffness a workpiece engaging jaw removably secured to said head portion and defining a portion of said drive track, and a clip member for releasably holding said jaw onto said housing, said clip member including first and second legs and a bight portion engaging said jaw, said first and second legs each including a detent and said tool including apertures for capturing each said detent.

21. The improvement in the tool set forth in claim 20 wherein said reciprocating means comprises a solenoid and said plunger comprises an armature of said solenoid.

22. The improvement in the tool set forth in claim 21 wherein said head portion includes spring members defined thereon engaging and securely holding said solenoid in the housing.

23. The improvement in the tool set forth in claim 21 wherein said jaw includes first and second workpiece engaging portions for engaging different workpieces.

24. The improvement in the tool set forth in claim 21 further comprising a magazine assembly secured to said housing, said magazine assembly including a frame member including an open bottom and at least one fastener support member mounted in said frame member for supporting said fasteners over said open bottom allowing access to said fasteners in said magazine assembly.

25. The improvement in the tool set forth in claim 21 further comprising a connecting stem secured to said plunger and to one of said first and second portions of said biasing means.

26. A fastener driving tool comprising:

a housing defining a nose portion and a handle portion, said nose portion defining a first portion of a drive track;

a driver blade mounted for reciprocation in said drive track;

a nose piece defining a second portion of said drive track, said nosepiece removably secured to said housing and including first and second workpiece engaging ends of different configurations; and further comprising means for driving said blade and biasing means for returning said blade to a normal, at rest position, said biasing means comprising a double cone spring including a first portion of a first flexibility and a second portion of a second flexibility.

27. The tool claimed in claim 26 further comprising a fastener magazine assembly secured to said housing, said magazine assembly including a frame defining an open bottom providing access to said fasteners.

28. A fastener driving tool comprising:

a body defining a handle portion and a nose portion;

a drive track defined at least in part by said nose portion;

a driver for driving fasteners mounted in said drive track:

a magazine assembly for supplying said fasteners to said drive track, said magazine assembly including a frame and first and second identical track members for supporting said fasteners in said frame, said frame defining an open bottom allowing access to said fasteners in said magazine assembly; and further comprising return means for returning said driver to a ready to fire position, said return means including a solenoid mounted in said housing, a magnetic armature of said solenoid mounted in said housing, said driver connected to said armature, a connecting rod secured to said armature, and a spring including a first portion engaging said housing and a second portion secured to said rod, said second portion being less flexible than said first portion said frame is of an inverted U-shaped configuration and said track members are of a U-shaped configuration with a first leg longer than a second leg, each said second leg secured to said frame and each said first leg supporting said fasteners.

29. The tool claimed in claim 28 further comprising a removable jaw attached to said nose portion and defining at least a portion of said drive track, said jaw including first and second workpiece engaging surfaces.

30. A fastener driving tool for driving fasteners into a workpiece comprising:

a body defining a nose portion and a gripping portion;

a drive track defined in part by said nose portion;

a removable nose piece defining another part of said drive track;

a driving blade for driving said fasteners mounted in said drive track;

means for driving said blade;

return means for returning said blade to an at rest position, said return means including a plunger connected to said blade, a rod connected to said plunger and a biasing element connected to said rod;

a U-shaped magazine for supplying fasteners to said drive track, said magazine including an open bottom allowing access to said fasteners in said magazine, and said biasing element comprises a spring including a first, rigid portion secured to said rod and a second less rigid portion relative to said first portion engaging said body said nosepiece includes first and second selectable workpiece engaging surfaces of different configurations.

31. The tool set forth in claim 30 wherein said magazine includes an inverted U-shaped frame defining the top of said magazine and at least one fastener support track in said frame.

32. In a tool for driving fasteners into a workpiece, a fastener magazine, drive track means having a discharge opening and receiving fasteners from the magazine, and driving means movable through the drive track means to discharge fasteners from the discharge opening the improvement comprising a structure having two spaced portions of different configurations each adapted to engage a workpiece and means removably mounting the structure on the tool in two different positions in which different ones of the spaced portions are disposed adjacent the discharge opening.

33. The tool set forth in claim 32 in which the structure includes wall means defining a part of said drive track.

34. In a fastener driving tool of the type including a housing defining a handle portion and a head portion, a drive track defined in said head portion, a driver blade mounted in said drive track and means for reciprocating said blade in said track, the improvement comprising a plunger secured in said head portion and reciprocated therein by said reciprocating means, one piece biasing means for biasing said plunger to an at rest position, said biasing means including a first portion of a first predetermined flexibility and a second portion of a second predetermined flexibility, a workpiece engaging jaw removably secured to said head portion and defining a portion of said drive track, and a clip member for releasably holding said jaw onto said housing, said clip member being generally U-shaped and including first and second legs and a bight portion, each said leg including a detent thereon, apertures defined in said housing to capture said detent on each of said first and second legs.

* * * * *